US008079130B2

(12) United States Patent
Hardouin-Finez

(10) Patent No.: US 8,079,130 B2
(45) Date of Patent: Dec. 20, 2011

(54) METHOD FOR ASSEMBLING SHEETS BY RIVETING

(75) Inventor: Maxime Hardouin-Finez, Marly (FR)

(73) Assignee: Sonaca S.A., Gosselies (BE)

( * ) Notice: Subject to any disclaimer, the term of this patent is extended or adjusted under 35 U.S.C. 154(b) by 579 days.

(21) Appl. No.: 12/294,570

(22) PCT Filed: Mar. 26, 2007

(86) PCT No.: PCT/EP2007/052870

§ 371 (c)(1),
(2), (4) Date: Sep. 25, 2008

(87) PCT Pub. No.: WO2007/110408

PCT Pub. Date: Oct. 4, 2007

(65) Prior Publication Data

US 2009/0144962 A1 Jun. 11, 2009

(30) Foreign Application Priority Data

Mar. 27, 2006 (BE) ..... 2006/0188

(51) Int. Cl.
*B21J 15/02* (2006.01)
*B23Q 17/00* (2006.01)

(52) U.S. Cl. ..... 29/525.06; 29/407.01; 29/407.05; 29/407.09; 29/407.1; 73/159; 73/849; 408/1 R; 408/9

(58) Field of Classification Search ..... 29/407.01, 29/407.05, 407.08, 407.09, 407.1, 525.06; 73/159, 849; 403/1 R, 3, 9, 11, 103
See application file for complete search history.

(56) References Cited

U.S. PATENT DOCUMENTS 2,814,167 A * 11/1957 Nichols et al. ..... 451/164
3,057,191 A * 10/1962 Holloway ..... 73/849
3,477,288 A * 11/1969 Muck et al. ..... 73/159
4,179,941 A * 12/1979 Walter ..... 73/854
4,198,180 A * 4/1980 Schultz ..... 408/9
4,208,718 A * 6/1980 Chung ..... 700/173
4,745,557 A 5/1988 Pekar et al.
6,044,918 A * 4/2000 Noser et al. ..... 173/176

(Continued)

FOREIGN PATENT DOCUMENTS

EP 1 457 851 A 9/2004

(Continued)

OTHER PUBLICATIONS

International Search Report for PCT/EP2007/052870; Jun. 27, 2007.

*Primary Examiner* — Essama Omgba
(74) *Attorney, Agent, or Firm* — Pearne & Gordon LLP

(57) ABSTRACT

The invention relates to a method for assembling sheets by riveting, comprising a step for piercing a hole through the sheets, followed by a step for placing a rivet in the pierced hole, the step for piercing a hole being executed by supplying an advance speed instruction of a piercing tool as well as a rotation speed instruction of this tool. According to the invention, a previous step for determining information on the local stiffness of the sheets (Info_stiffness) is also carried out at the level of the hole to be pierced, the advance speed instruction and rotation speed instruction of the tool being a function of this information on the local stiffness of the sheets.
Application most suited to the field of aircraft construction.

9 Claims, 6 Drawing Sheets

U.S. PATENT DOCUMENTS

| | | | | |
|---|---|---|---|---|
| 6,092,275 | A * | 7/2000 | Kellner et al. | 29/525.06 |
| 6,419,426 | B1 * | 7/2002 | Chalupa et al. | 408/1 R |
| 6,925,725 | B2 * | 8/2005 | Herrmann et al. | 33/638 |
| 7,243,440 | B2 * | 7/2007 | DeKeyser | 33/626 |
| 7,346,971 | B2 * | 3/2008 | Chitty | 29/243.523 |
| 7,503,196 | B2 * | 3/2009 | Chitty et al. | 72/21.4 |
| 2002/0050043 | A1 * | 5/2002 | Sarh et al. | 29/407.01 |
| 2004/0055173 | A1 | 3/2004 | Herrmann et al. | |
| 2006/0117547 | A1 * | 6/2006 | Ffield et al. | 29/525.06 |
| 2009/0245956 | A1 * | 10/2009 | Apkarian et al. | 408/1 R |
| 2011/0020084 | A1 * | 1/2011 | Brett et al. | 408/1 R |
| 2011/0119897 | A1 * | 5/2011 | Hardouin-Finez | 29/525.06 |

FOREIGN PATENT DOCUMENTS

| | | | |
|---|---|---|---|
| GB | 1 293 759 | A | 10/1972 |
| WO | 2006-013450 | | 2/2006 |
| WO | WO 2007110408 | A1 * | 10/2007 |
| WO | WO 2009117836 | A1 * | 10/2009 |

* cited by examiner

METHOD FOR ASSEMBLING SHEETS BY RIVETING

TECHNICAL FIELD

The present invention relates generally to the field of assembling sheets or thin metallic structures by riveting, this technique being widespread in aviation construction operations.

The invention can in fact be applied most suitably but non-limiting in the field of robot assembly of aircraft sheets by riveting, having a sharply curved piercing/riveting surface, such as for example the leading edge of a wing, or else a weaker curve, such as an aircraft fuselage panel.

PRIOR ART

In the prior art, the methods for assembling sheets by riveting are usually employed by successively performing a step for piercing a hole through the sheets to be assembled, then a step for placing a rivet in the pierced hole, this combination of steps able to be repeated as many time as necessary at different points on the sheets.

This type of method, which can optionally be carried out by unique tooling at the same time incorporating a piercing system and a riveting system has never proven entirely satisfactory to date in terms of the quality of resulting holes and/or the millings, especially in the field of assembling sheets making up a leading edge of an aircraft wing. In this respect, it should be noted that these millings are generally provided for accommodating the head of the rivet located in its corresponding hole.

In fact, irrespective of the type of tooling employed, it has been ascertained that using these assembling methods clearly did not guarantee the formation of a perfectly circular hole and/or even milling on the sheets to be assembled.

OBJECT OF THE INVENTION

The aim of the invention is thus to propose a method for assembling sheets by riveting rectifying the problems mentioned hereinabove, and relative to the executions of the prior art.

To this end, the object of the invention is a method for assembling sheets by riveting, comprising a step for piercing a hole through the sheets followed by a step for placing a rivet in the pierced hole, the step for piercing a hole being performed by providing an advance speed instruction of a piercing tool as well as a rotation speed instruction of this tool. According to the invention, a previous step for determining information on the local stiffness of the sheets Info_stiffness is also employed at the level of the hole to be pierced, the advance speed instruction and rotation speed instruction of the tool being a function of this information on the local stiffness of the sheets.

Therefore, considering information on the local stiffness of the sheets for controlling the piercing operation of a hole, which conventionally but non-limiting comprises making this hole as well as preferably that of milling intended for taking up the rivet head, it is advantageously possible to guarantee forming a perfectly circular hole and even milling at one end of the latter. Effectively, correction of the advance speed and rotation speed instructions of the tool as a function of the stiffness of the sheets at the particular point where piercing is subsequently carried out considerably eases, or even completely eradicates, the problems encountered in the prior art, such as ovalisation of the hole, delaminating of the composite, the fins in the form of a crater at the exit of the hole, or even producing an undesired rough surface. In fact, the abovementioned instructions are corrected with the local information on the stiffness so that the thrust generated by the tool on the sheets during piercing does not cause contact rupture between the sheet press system and these same sheets.

The step for determining information on the local stiffness of the sheets Info_stiffness at the level of the hole to be pierced is preferably performed by carrying out a clamping operation aimed at sinking a sheet press system in the sheets at the level of the hole to be pierced over a clamping distance D_clamping reaching a final value D_clamping_final on completion of the clamping operation, an operation during which is determined periodically the value of a resistance force of the sheets to clamping F2 resulting from sinking of the sheet press system in the sheets, to then determine a resistance force value of the sheets on completion of clamping F2_final, at the end of the clamping operation. It is noted that since updating of the value of this force F2 during the clamping operation can occur for example every 5 ms, especially allowing tracking of the evolution of the latter.

In addition, the fact of also precisely tracking the shift distance of the sheet press system during the clamping operation, called clamping distance, D_clamping, helps discover the real position of the restricted sheets due to the final value D_clamping_final on completion of the clamping operation, and thus of performing milling having exactly the desired depth.

Determining the value of the resistance force of the sheets to clamping F2 is preferably conducted by determining the value of the motor power P2_absorbed absorbed by the sheet press system sinking into the sheets, this value of the absorbed motor power P2_absorbed then being converted by a converter to obtain the value of the resistance force of the sheets to the clamping F2.

The clamping operation is preferably completed when the resistance force of the sheets to the determined clamping F2 has reached a target value F2_target or when the clamping distance D_clamping has reached a target value D_clamping_target.

More preferably, the step for determining information on the local stiffness of the sheets Info_stiffness at the level of the hole to be pierced is also carried out, prior to initiating the clamping operation, by providing a docking operation of the sheet press system on the sheets at the level of the hole to be pierced, an operation during which the value of a resistance force of the sheets to docking F1 resulting from sinking the sheet press system into the sheets is determined periodically so as to determine a resistance force value of the sheets on completion of docking F1_final, at the end of the docking operation.

In such a case, it is provided that the clamping operation is started with the sheet press system located in a position such as occupied on completion of the docking operation, by marking a stop time between the two successive operations.

The information on the local stiffness of the sheets Info_stiffness is preferably obtained by making the ratio between on the one hand the difference between the value of the resistance force of the sheets on completion of clamping F2_final and the value of the resistance force of the sheets on completion of docking F1_final, and on the other hand the final value of the clamping distance D_clamping_final. Nevertheless, it is noted that this information could be alternatively obtained by making the ratio between the value of the resistance force of the sheets on completion of clamping F2_final and the final value of the clamping distance D_clamping_final, without departing from the scope of the invention.

In addition, it is also preferably provided that the advance speed instruction and rotation speed instruction of the tool are also a function of the nature of the material of the sheets to be assembled, and of the type of piercing tool employed.

More preferably, during the piercing step of the hole, the value of a resistance force of the sheets F3 resulting from the support of the sheet press system on the sheets is determined periodically, and the latter is compared to a minimal value F3_min so as to order a decrease in the advance speed instruction of the piercing tool when it is detected that the value of this resistance force of the sheets F3 is less than said minimal value F3_min, for example fixed at 5 N.

Therefore, this additional security, added to that resulting from the predisposition of the rotation and advance speeds of the tool as a function of the information on the local stiffness, arrests the advance motor of the tool to avoid the thrust of this tool causing rupture of the contact between the sheet press head and the sheets to be assembled.

Also, the object of the invention is also a control system for a device intended for assembling sheets by riveting, capable of ensuring execution of the method described hereinabove. This system thus comprises means for delivering an advance speed instruction of a piercing tool of the device, as well as a rotation speed instruction of this tool, these instructions being a function of information on the local stiffness of the sheets at the level of a hole to be pierced intended to receive a rivet.

Other advantages and characteristics of the invention will emerge from the detailed non-limiting description hereinbelow.

BRIEF DESCRIPTION OF THE DRAWINGS

This description will be given with reference to the attached drawings, in which.

DETAILED DESCRIPTION OF PREFERRED EMBODIMENTS

Figure 1:
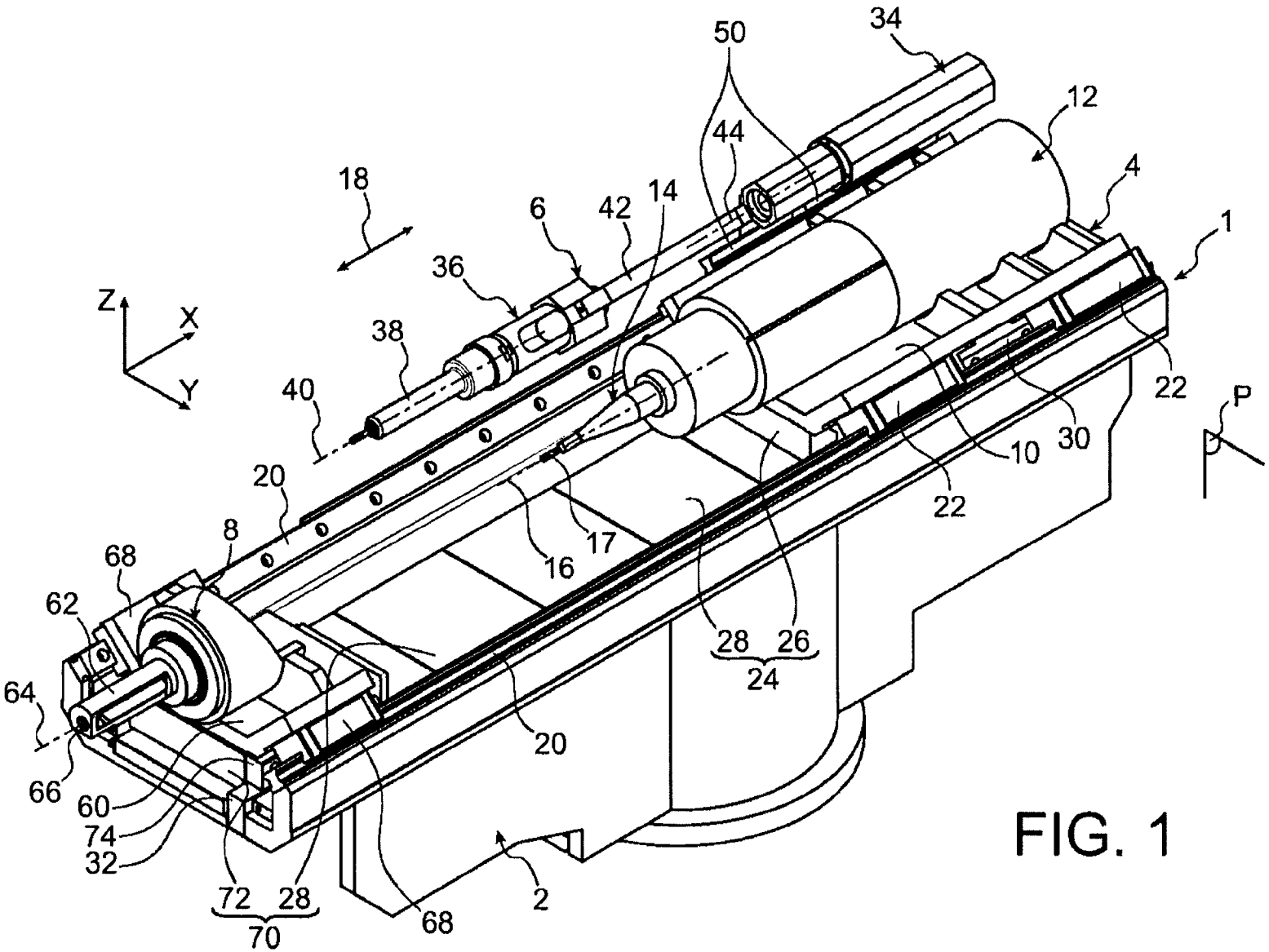
FIG. 1 illustrates a partial perspective view of a device for assembling sheets by riveting, intended for carrying out an assembling method by riveting according to a preferred embodiment of the present invention.
Figure 2:
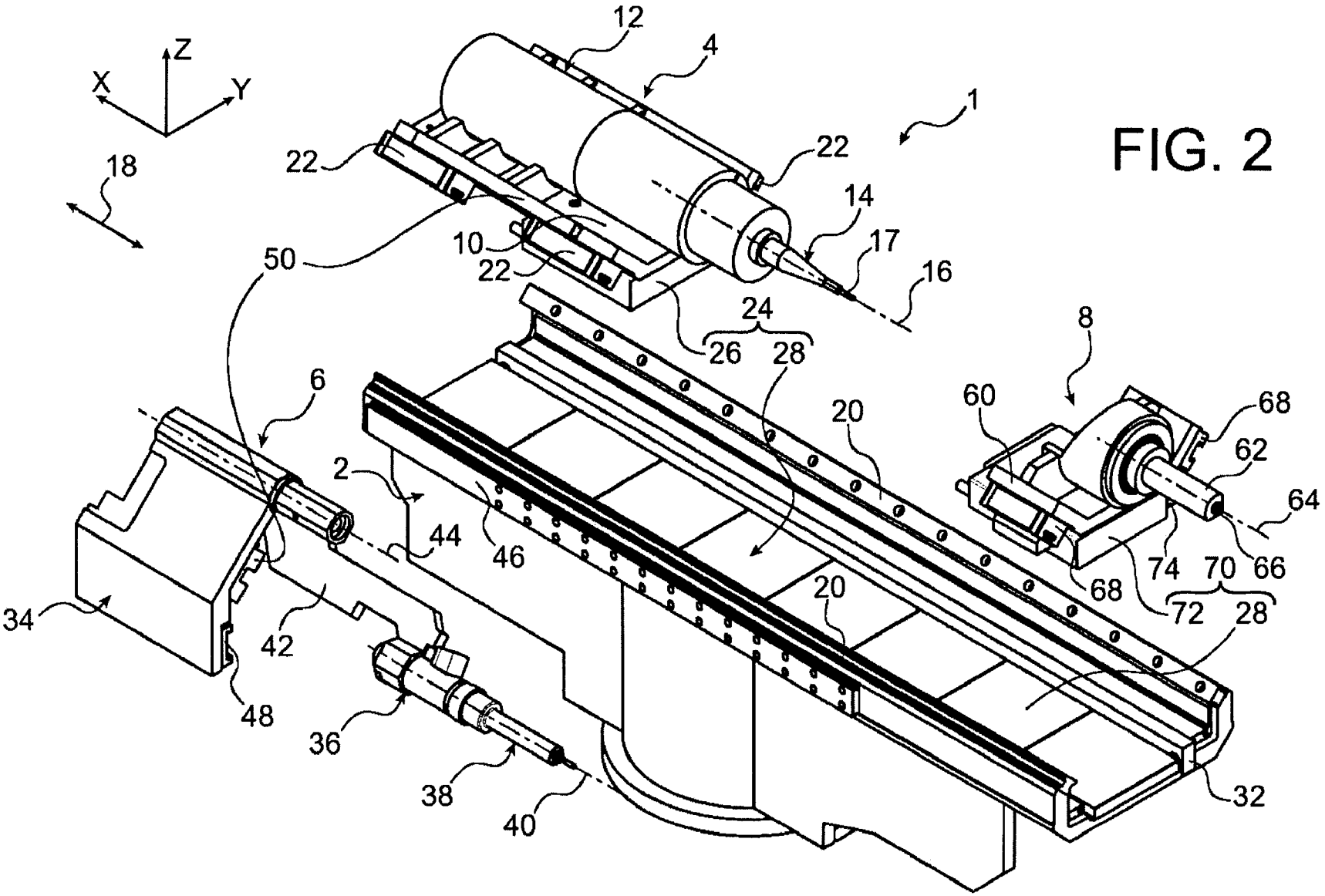
FIG. 2 illustrates an exploded perspective view of the device shown in FIG. 1.

Initially in reference to both FIGS. 1 and 2, these show the front part of a device 1 for assembling sheets by riveting, of the metallic type or made of any other material such as composite material, this device 1 being intended for executing an assembling method by riveting according to a preferred embodiment of the present invention. Naturally, this device 1 is described only by way of indication, and it must of course be understood that the assembling method by riveting can be carried out by any other type of device.

The method according to the invention, which is applied most suitably in the field of aircraft construction, can be adapted for allowing automatic placing of any type of rivets, such as draw rivets, and/or struck rivets, and/or crushed rivets, without departing from the scope of the invention. However, it is noted that the device 1 is preferably designed to work blind, with draw rivets.

The front part of the device 1 illustrated in FIGS. 1 and 2 concerns only an end portion of this device, and preferably constitutes a mountable/demountable tool intended to be assembled at the end of a robotic arm (not shown) preferably forming an integral front part of this device. For the sake of clarity, the description of the device 1 will be given in reference to a system of axes of this device, which is specifically attached to a chassis 2 of the latter, also called a tool chassis. Therefore, X is the longitudinal direction of the device, Y the direction oriented transversally relative to this device, and Z the vertical direction or the height, these three directions being orthogonal to one another. Naturally, it must be understood that the abovementioned axes system moves according to the same movement as that of the chassis 2, controlled by the robot arm.

The device 1 thus comprises overall three systems attached to the chassis 2 and intended to ensure different functions, specifically a piercing system 4, a riveting system 6, and a sheet press system 8. By way of information, it is indicated that these systems are also called actuators.

With respect to the piercing system 4, the latter has a first carriage 10 supporting the piercing spindle 12 assembly, having at the level of its front part a piercing head 14 equipped with a piercing tool 17 and defining a piercing head axis 16, also called a piercing tool axis, according to which this same tool is arranged. More precisely, the spindle 12 is mounted fixed on the carriage 10, such that the relative position between the piercing head axis 16 oriented according to the direction X, and this same carriage 10, is intended to remain identical throughout an assembling cycle by riveting. By way of indication, the piercing head 14 conventionally comprises the piercing tool 17, as well as the support of this tool, of the mandrel type or similar.

The first carriage 10 is mounted on the chassis 2 so as to be able to slide in a rectilinear direction relative to the latter, according to a direction of slide 18 parallel to the direction X. To this end, the carriage 10 is mounted sliding on two guide rails 20 oriented according to the direction X, these two rails 20 being spaced from one another in the direction Y.

To allow securing to the rails 20, the carriage 10 is equipped with a plurality of ball skids 22 in the form of a stirrup, for example provided with four in number, with two of them linked to the rails 20, and the two others linked to the other of these rails.

To allow shift in the direction of slide 18 of the first carriage 10 relative to the chassis 2, the piercing system 4 integrates movement means 24 which preferably take the form of a linear motor integrating a primary mobile element 26 seated on the first carriage 10, and a secondary fixed element 28 mounted on the chassis 2.

As is clearly visible in FIGS. 1 and 2, the chassis 2 has in section according to a plane YZ a general U-shape, at both ends of which are fixed the two rails 20. Provided between the two branches of this U is a magnetic track made of permanent rear-earth magnets, alternating all along this same track the north and south polarisations. This track, placed under the first carriage 10, thus constitutes the secondary fixed element 28 of the linear motor 24.

Therefore, activation of the solenoid equipping the primary mobile element 26 of the linear motor 24 creates electromagnetic forces on the one hand ensuring shift according to the direction X of the first carriage 10 on the rails 20, and on the other hand attraction according to the direction Z of this same carriage 10 to the secondary fixed element 28.

To obtain micrometric precision in the shift of the carriage 10, it is provided that the latter is equipped with a reading head 30 cooperating with an optical rule 32 placed on the chassis 2, according to the direction X. This rule 32 is preferably constituted by a glass rod bearing very high-precision graduations. Therefore, the reading head 30 converts the detection of engraving read on the rule 32 into electronic signals during passage of the carriage 10, to give its exact position on the guide rails 20.

Still in reference to FIGS. 1 and 2, the riveting system 6 itself comprises a second carriage 34 supporting the assembly of the riveting tool 36 or riveter, which comprises in its front part a rivet heading 38, defining a rivet heading axis 40 parallel to the directions X and 18. More precisely, the rivet heading 38, and more generally the riveting tool assembly 36, is mounted solid at the front of a deportation arm 42 extending broadly according to the direction X, and whereof the rear part is attached mechanically to the carriage 34.

The abovementioned mechanical attachment is made by way of movement means (hidden in the figures) designed to place in rotation the arm 42 and the head 38 integral therewith relative to the carriage 34 around an axis of rotation 44, with the aim of shifting this same rivet heading 38 between a rest position in which the piercing head axis 16 and the rivet heading axis 40 are distinct and parallel, as shown in FIG. 1, and a work position in which these axes 16, 40 are joined. The movement means preferably take the form of a classic rotary motor, whereof the axis of rotation 44 is preferably parallel to the directions X and 18, and naturally distinct from the piercing head and rivet heading axes 16, 40. Due to this, starting up the rotary motor causes a movement of the head 38 relative to the carriage 34, this movement describing a trajectory corresponding to a portion of a circle situated in a plane YZ.

The second carriage 34 is mounted on the chassis 2 so as to be able to slide in a rectilinear direction relative to the latter according to the direction of sliding 18. To this end, the second carriage 34 is mounted sliding on a guide rail 46 preferably distinct from the two guide rails 20 of the carriage 10, but also oriented according to the directions X and 18.

To allow securing on the rail 46, the carriage 34 is equipped with one or a plurality of ball skids 48 in the form of a stirrup, two of which for example are provided, spaced according to the direction X.

The carriage 34 of the riveting system 6 preferably comprises no inherent translation means, but is provided to be able to couple with the carriage of the piercing system 4, and is consequently likely to be set in motion according to the direction 18 under the startup effect of the first linear motor 24 described earlier.

In fact, coupling means 50 are provided for coupling in translation the carriages 10, 34 to one another, when in an active state, according to the direction 18, and, when in an inactive state, for enabling relative sliding between these same carriages.

As for the sheet press system 8, the latter has a third carriage 60 supporting a sheet press head 62, also called a pressurisation cylinder, and which defines a sheet press head axis 64 oriented according to the directions X and 18. As known to those skilled in the art, the head 62, intended to contact the sheets to be assembled during the piercing and riveting operations is provided with a continuous orifice 66 arranged according to the sheet press head axis 64 and intended to alternatively have the piercing tool 17 and the rivet heading 38 pass through it. More precisely, this head 62 or cylinder is mounted fixed on the carriage 60, such that the relative position between the sheet press head axis oriented according to the direction X and this same carriage 60 is intended to remain identical throughout an assembling by riveting cycle. Also, the axes 64 and 16 are permanently joined during an assembling by riveting cycle.

The third carriage 60 is mounted on the chassis 2 to be able to slide in a rectilinear direction relative to the latter according to the direction of sliding 18. To this end, the carriage 60 is mounted sliding on the two guide rails 20, at the front relative to the first carriage 10 of the piercing system, given naturally that the front and rear are determined here as a function of the orientation of the piercing tool 17 employed by the system 4.

To allow securing on the rails 20, the carriage 60 is equipped with a plurality of ball skids 68 in the form of a stirrup, two of which for example are provided, each associated with the two rails. To allow shift in the direction of sliding 18 of the third carriage 60 relative to the chassis 2 the sheet press system 8 integrates movement means 70 which preferably take the form of a linear motor integrating a primary mobile element 72 on board the third carriage 60, as well as a secondary fixed element 28 mounted on the chassis 2, and which is preferably the same as that used for the first linear motor, with the aim of limiting to the maximum the number of kinematic components necessary for running the device 1.

Therefore, here also, activation of the solenoid equipping the primary mobile element 72 of the linear motor 70 creates electromagnetic forces ensuring on the one hand the shift according to the direction X of the third carriage 60 on the rails 20, and on the other hand attraction according to the direction Z of this same carriage 60 to the secondary fixed element 28 of the permanent magnet track type.

To also produce micrometric precision in the shift of the carriage 60 it is provided that the latter is equipped with a reading head 74 cooperating with the abovementioned optical rule 32 placed on the chassis 2. Because of this, it is thus possible to fully control the relative spread of the two carriages 10 and 60, the advantage of which is to fully control the depth of the holes and the millings made by means of the piercing tool.

Figure 3:
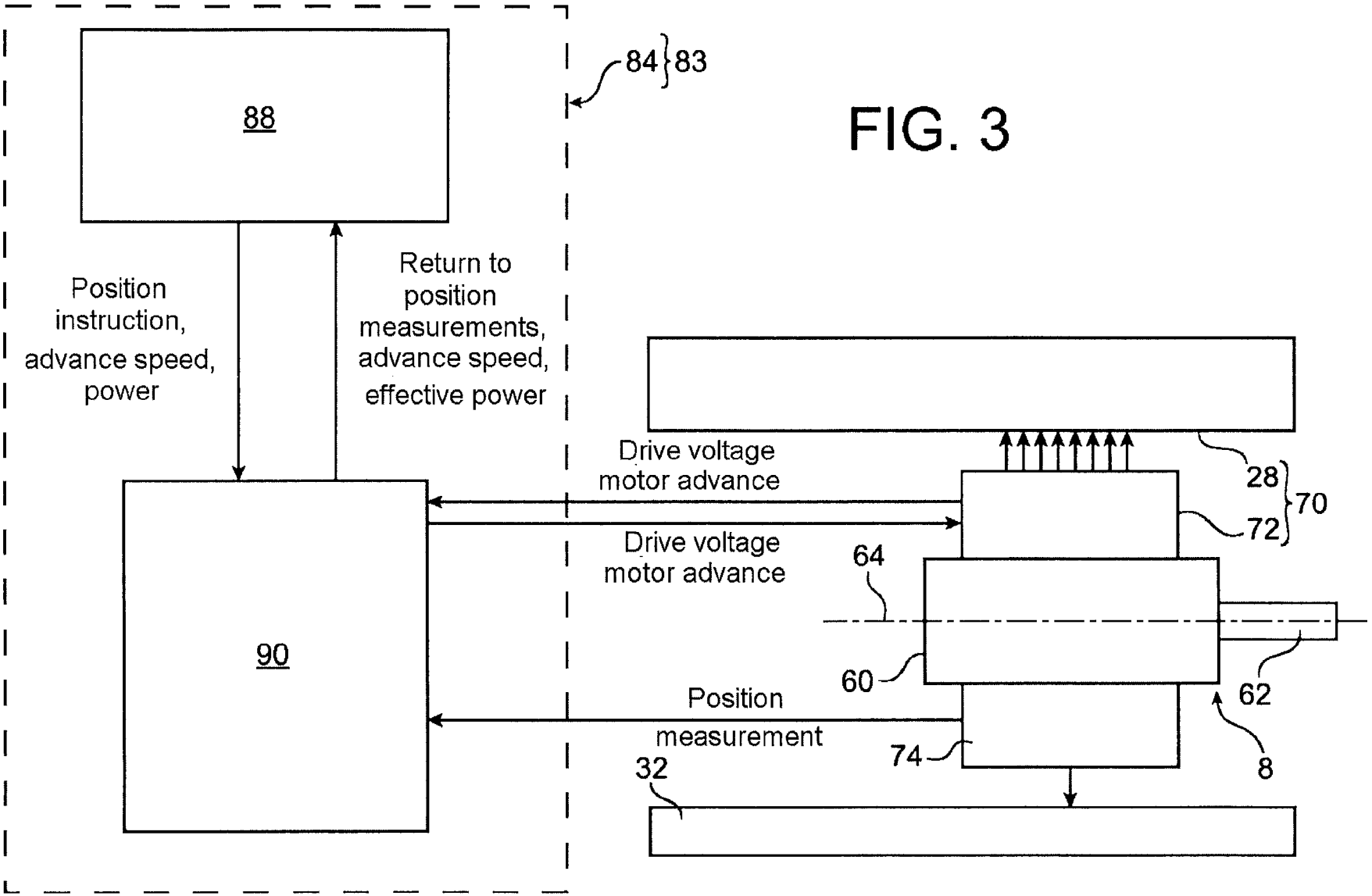
FIGS. 3 to 5 illustrate schematic views of different parts of a control system according to a preferred embodiment of the present invention, this system equipping the device shown in FIGS. 1 and 2 and FIGS. 6*a* to 6*c* show the front part of the device of FIGS. 1 and 2 at different stages during execution of the assembling method by riveting according to said preferred embodiment of the present invention, and more particularly during the step for determining information on the local stiffness of the sheets at the level of said hole to be pierced.
Figure 4:
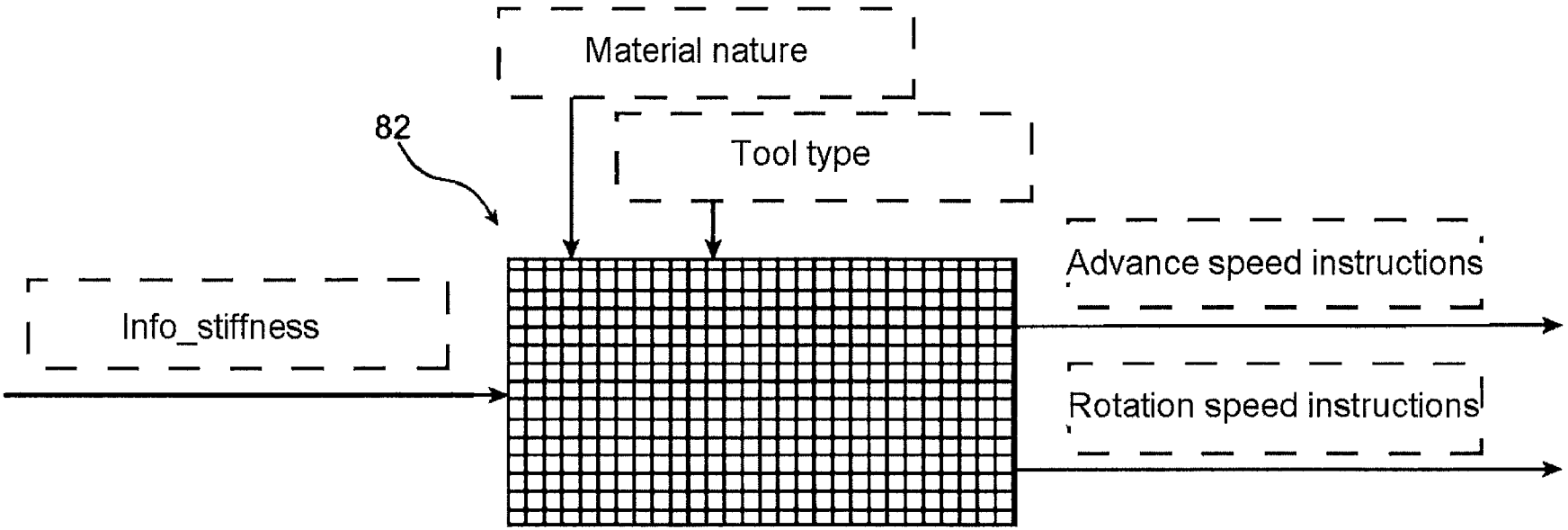
Figure 5:
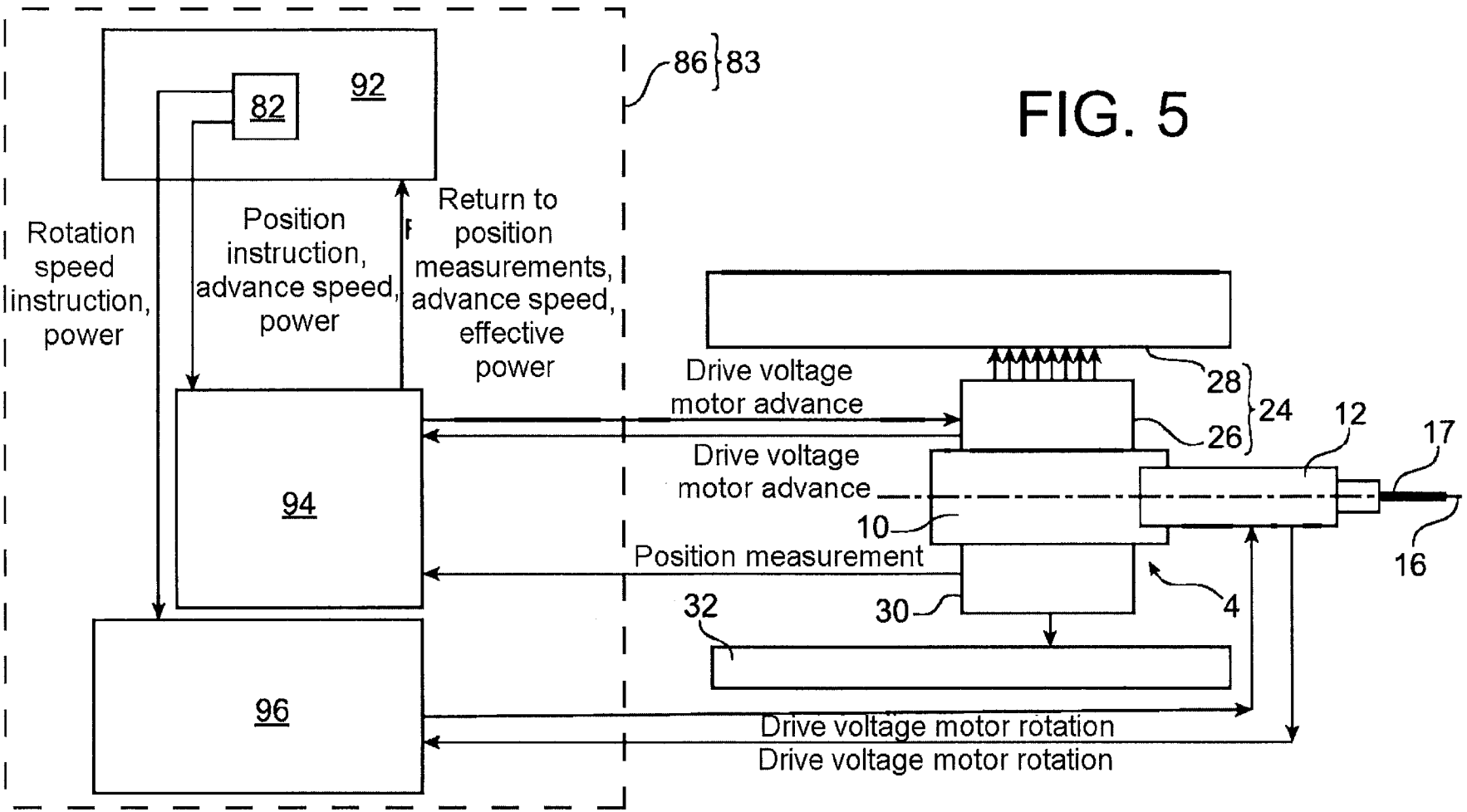

To be able to control this device 1 as wanted, it is also equipped with a control system 83 shown schematically in FIGS. 3 to 5. Overall, this system 83 comprises first control means 84 which are linked to the sheet press system 8, and second control means 86 which are linked to the piercing system 4, these means 84, 86 naturally being able to be combined inside the same equipment.

As for the first means 84 shown in FIG. 3, they comprise a first digital control unit 88 linked to a closed loop control card 90 of the linear motor 70 of the sheet press system 8. The unit 88 is thus capable of delivering instructions on position, advance speed and power to the card 90, which thus gives feedback control on position, advance speed and power, by supplying appropriate current to the motor 70 to which this card 90 is linked.

In return, the closed loop control card 90 receives from the reading head 74 information on the real position of the carriage 60, this information being returned to the unit 88. In addition, this closed loop control card 90 is also capable of returning to the unit 88 measurements on the advance speed of the carriage 60 and the effective power, this effective power allowing the unit 88 to determine the motor power absorbed by the system 8 during the docking and clamping operations.

With respect to the second means 86 shown in FIG. 5, they comprise a second digital control unit 92 attached to a closed loop control card 94 of the linear motor 24 of the piercing system 4. The unit 92 is thus capable of delivering instructions on position, advance speed and power to the card 94, which then gives feedback control on position, advance speed and power, by supplying appropriate current to the motor 24 to which this card 94 is attached. In return, the closed loop control card 94 receives from the reading head 30 information on the real position of the carriage 10, this information being returned to the unit 92. In addition, this closed loop control card 94 is also capable of returning to the unit 92 measurements on the advance speed of the carriage 10 and optionally the effective power.

Also, the digital control unit 92 is attached to a closed loop control card 96 of the rotary motor of the spindle 12. The unit 92 is thus capable of supplying instructions on rotation speed and power to the card 96, which then gives feedback control on rotation speed and power, by supplying appropriate current to the rotary motor to which this card 96 is attached. In return, it can be provided that this closed loop control card 96 returns to the unit 92 measurements on the rotation speed of the tool 17 and the effective power.

In this respect, it is indicated that one of the particular features of the invention is that the unit 92 comprises means 82 for delivering, respectively to the cards 94 and 96, advance speed instruction on the tool and rotation speed instruction on this tool which are a function of information on the local stiffness of the sheets at the level of the hole to be pierced intended to receive a rivet, this information being called Info_stiffness.

More specifically in reference to FIG. 4 it is evident that these means 82 for example take the form of a correction matrix of both abovementioned instructions, this matrix thus not only considering the information Info_stiffness determined earlier, but also optionally the nature of the material and the type of the piercing tool whereof the data are preregistered in a specific program. Of course, this correction matrix is designed for the advance speed and rotation instructions it supplies to the cards 94, 96 to carry out piercing with as high as possible quality and precision.

The assembling by riveting method carried out by means of the device 1 presented hereinabove will now be described, this method comprising a step for determining information on the local stiffness of the sheets at the level of the hole to be pierced, followed by a piercing step aimed at making the hole as well as the associated milling, then finally a step for placing a rivet in said pierced hole, these three steps being repeated as many times as there are rivets to be placed on the sheets to be assembled.

In reference to FIGS. 6*a* to 6*c*, these show a front part of the device 1 at different stages during execution of the step for determining the information Info_stiffness, this determining step essentially being carried out during docking and clamping operations made with the sheet press system 8, as will be described hereinbelow.

Figure 6A:
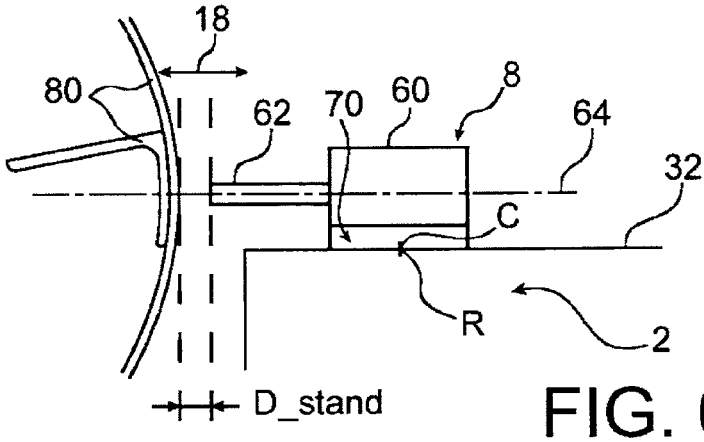
Figure 6B:
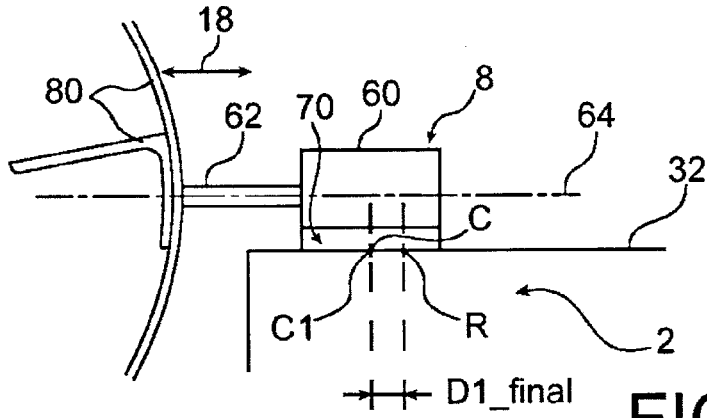
Figure 6C:
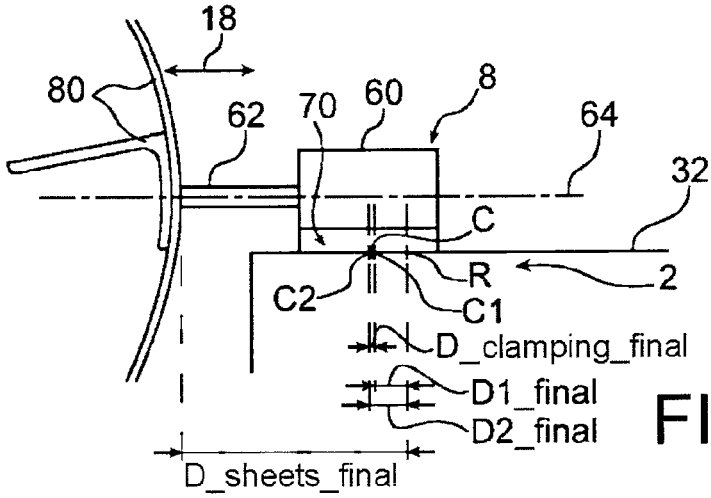

In reference to FIG. 6*a*, this shows that the chassis 2 is first guided by the robot arm to near the sheets 80 to be assembled so that the front end of the sheet press head 62 is located at a standard distance D_stand from the sheets 80 according to the direction of sliding 18 and that of the axis 64, this distance able to be of the order of 15 mm. At this stage, the carriage 60 is in a position such that its central point C is located at the level of a reference point R of the optical rule 32.

Then, the docking operation is initiated by commanding linear shift of the carriage 60 with the unit 88, so as to make contact between the head 62 and the sheets 80. It is noted that from establishment of the abovementioned contact the control unit 88 periodically determines the value of the absorbed motor power P1_absorbed by the system 8, this value P1_absorbed then being converted by a converter integrated into the unit 88 to produce a value of the resistance force of the sheets to the docking F1. By way of indication, it is noted that this force F1, updated every 5 ms, also corresponds in value to a sinking effort of the sheet press system 8 against the sheets 80.

Command of this docking operation is provided so that the shift of the system 8, and more specifically that of its carriage 60, is completed when the determined force F1 has reached a target value F1_target, which can for example be fixed to a weak value of the order of 1 N. As shown in FIG. 6*b*, on completion of the docking operation the carriage 60 has thus travelled a distance D1_final between point R and point C1 of the rule 32 at the level of which the point C of the carriage 60 is situated, the value of this distance D1_final measured by means of the rule 32 being returned to the unit 88. In addition, at this instant the value of the resistance force of the sheets on completion of docking, called F1_final, which is naturally substantially identical to the force F1_target, becomes known and is registered by means of the unit 88.

In addition, error detection by means of the value of the distance D1_final registered can be carried out. In fact, if this value is not in a predetermined range, it can then be concluded that the device is incorrectly positioned relative to the sheets, or that these sheets comprise a form beyond tolerance.

Then, the clamping operation is initiated, which is started as soon as the docking operation ends, with optionally a stop time between these two operations. Identically to that encountered within the scope of the previous operation clamping is performed by controlling linear shift of the carriage 60 with the unit 88 to produce reinforced adherence between the head 62 and the sheets 80 in contact. It is noted that during this operation the control unit 88 periodically determines on the one hand the value of the absorbed motor power P2_absorbed by the system 8, this value P2_absorbed then being converted by the converter to produce a value of the resistance force of the sheets to the clamping F2, and on the other hand the clamping distance D_clamping corresponding to the real distance travelled by the point C of the carriage between the point of the optical rule 32 at the level of which it is located at the instant t in question, and the point C1 of this rule. Here too, it is specified that the force F2, updated every 5 ms as is the value D_clamping, also corresponds in value to a sinking effort of the sheet press system 8 against the sheets 80.

Command of this clamping operation is provided so that shifting of the carriage 60 is completed when the determined force F2 has reached a target value F2_target, or when the clamping distance D_clamping has reached a target value D_clamping_target, the clamping operation thus being completed as soon as any one of these two target values has been reached.

By way of indication, the target value F2_target can for example be fixed at a value of the order of 150 N, and the target value D_clamping_target can for example be fixed at a value of the order of 500 μm. As shown in FIG. 6*c* on completion of the clamping operation the carriage 60 has travelled a distance D2_final between point R and point C2 of the rule 32 at the level of which the point C of the carriage 60 is located, the value of this distance D2_final measured by means of the rule 32 being returned to the unit 88. This then produces the final clamping distance D_clamping_final actually covered by the system 8, by subtracting D1_final from D2_final. Also, knowledge on the one hand of the dimensions of the system 8 and on the other hand of the real position of the latter on the chassis 2 on completion of the clamping operation helps determine the exact position of the restricted sheets 80 relative to the chassis 2. In this respect, the unit 88 can then determine then store the distance D_sheets_final corresponding to the distance according to the direction 18 between the point R of the rule 32 and the front end of the sheet press head 62 on completion of the clamping operation.

This specificity is advantageous since it best optimises the linear shift of the piercing system 4 during the subsequent piercing step, to the extent where this system 4 can be controlled at high speed over a precise distance fixed as a function of the distance D_sheets_final, before being slowed to the advance speed of the tool previously determined. In addition, knowing this distance D_sheets_final, of the order of 200 mm, precisely fixes the distance of change in rotation speed of the piercing tool for the milling attack, when a boring-milling tool stage is used. Finally, another advantage is that the depth of the milling can be fully respected. In this way, it is indicated that the course of subsequent milling can also be corrected as a function of the information Info_stiffness determined as described hereinbelow, and also optionally as a function of diverse characteristics of the rivets employed. In this respect, it is noted that the weaker the local stiffness of the sheets, the more these are deformed by the thrust of the sheet press head, and thus the more the centre of this sheet press head is moved away from these same deformed sheets. Therefore, the weaker the local stiffness of the sheets, the greater importance of the course of milling relative to the sheet press system to obtain a determined depth of milling.

In addition, error detection can also be conducted by means of the value of the registered distance D_clamping_final. In fact, if this value is not in a predetermined range it can be concluded that the device is incorrectly positioned relative to the sheets, or these sheets comprise a form beyond tolerance. In addition, at the end of the clamping operation stopped when the target value D_clamping_target has been reached, the value of the resistance force of the sheets on completion of clamping, called F2_final, becomes known and is registered by means of the unit 88. If this value is too low, it can be considered that the structure constituted by the sheets is non-existent.

With the value of the resistance force of the sheets on completion of clamping F2_final it is possible to determine, still by means of the unit 88, the information Info_stiffness by establishing the following ratio:

$$\text{Info_stiffness}=(F2_\text{final}-F1_\text{final})/D_\text{clamping_final}$$

This information on the local stiffness of the sheets, whereof the value is for example of the order of 30 kg/mm, is then supplied to the second control means 86 linked to the piercing system 4, and more particularly to the correction matrix 82 equipping the unit 92. As indicated previously, this information Info_stiffness is provided to predispose the advance speed and rotation speed instructions of the tool 17 used during control of the piercing step.

Then, the piercing step is effectively undertaken, consisting of setting in motion the carriage 10 of the piercing system 4 such that the latter passes through the sheet press system 8, and also passes through the two sheets 80 to be assembled to produce the desired hole and milling.

Piercing is carried out by controlling the linear shift of the carriage 10 with the advance speed instruction of the tool such as previously determined and originating from the matrix 82, and by simultaneously controlling rotation of the spindle 12 with the rotation speed instruction of the tool also originating from this matrix 82, these instructions being supplied to the feedback control cards 94 and 96 respectively.

During this piercing step, the value of a resistance force of the sheets F3 resulting from support of the sheet press system 8 on the sheets 80 is determined periodically. This determination of F3 is preferably executed in the same way as that adopted for determining F1 and F2. In this way, it is indicated that the motor linked to the carriage 60 of the sheet press system continues to be fed during piercing, and that it is synchronised in position such that the carriage 60 retains its position in C2 on the chassis 2.

By way of indication, F3 is updated every 5 ms and corresponds in value to a sinking effort of the sheet press head 62 in the sheets 80, during piercing.

This allows periodical comparison during piercing, by means of the unit 92, of the value of this force F3 to a minimal value F3_min, the minimal value F3_min able for example to be fixed at 5 N.

When it is detected that F3 is less than F3_min, a decrease in the advance speed instruction of the piercing tool is then ordered via the matrix 82, so that the value of the force F3 rises above the minimal value F3_min. Therefore, this way of operating advantageously ensures that the sheet press head 62 does not lose contact with the sheets 80 during the piercing operation, following excessive thrust of the piercing tool 17 on these sheets.

Finally, once the piercing step is complete the step of placing the rivet can be started by placing in motion the riveting system 6 in the appropriate way.

Of course, various modifications can be made by the expert to the invention described hereinabove, purely by way of non-limiting example.

The invention claimed is:

1. A method for assembling sheets by riveting, comprising:

determining information on a local stiffness of the sheets at a level of a hole to be pierced, following said determining, piercing said hole through said sheets, wherein piercing the hole comprises: providing an advance speed instruction of a piercing tool and a rotation speed instruction of the piercing tool;

following said piercing the hole, placing a rivet in the pierced hole; and wherein said advance speed instruction and said rotation speed instruction of the piercing tool both being a function of said information on the local stiffness of the sheets, wherein said step for determining information on the local stiffness of the sheets at the level of said hole to be pierced is performed by carrying out a clamping operation aimed at sinking a sheet press system into the sheets at the level of said hole to be pierced, and wherein the sheet press system being intended to have the piercing tool pass through the sheets during the subsequent to piercing the hole.

2. The assembly method according to claim 1, wherein said step for determining information on the local stiffness of the sheets at the level of said hole to be pierced is performed by carrying out the clamping operation aimed at sinking a sheet press system into the sheets at the level of said hole to be pierced over a clamping distance reaching a final value on completion of the clamping operation, and wherein during a clamping operation, a value of a resistance force of the sheets to the clamping operation resulting from sinking the sheet press system into the sheets is determined periodically, to determine said value of the resistance force of the sheets to the clamping operation on completion of said clamping operation.

3. The assembly method according to claim 2, wherein determination of the value of the resistance force of the sheets to the clamping operation is performed by determining a value of the motor power absorbed by the sheet press system sinking into the sheets, and wherein the value of the motor power absorbed by the sheet is then converted by a converter to produce said value of the resistance force of the sheets to the clamping operation.

4. The assembly method according to claim 2, wherein said clamping operation is completed when one or more of, the resistance force of the sheets to the clamping operation has reached a resistance target value or when the clamping distance has reached a distance target value.

5. The assembly method according to claim 2, wherein said step for determining information on the local stiffness of the sheets at the level of said hole to be pierced is performed, prior to executing said clamping operation, by also carrying out a docking operation of the sheet press system on the sheets at the level of said hole to be pierced, and wherein said docking operation during which the value of a resistance force of the sheets to the docking operation resulting from sinking the sheet press system into the sheets is determined periodically to determine a resistance force value of the sheets to the docking operation on completion of the docking operation.

6. The assembly method according to claim 5, wherein said clamping operation is started with the sheet press system located in a position occupied on completion of the docking operation.

7. The assembly method according to claim 5, wherein the information on the local stiffness of the sheets is obtained by making a ratio between on the one hand the difference between the value of the resistance force of the sheets on completion of the clamping operation and the value of the resistance force of the sheets on completion of the docking operation, and on the other hand the clamping distance.

8. The assembly method according to claim 7, wherein said advance speed instruction and said rotation speed instruction of the piercing tool are also a function of one or more of, the nature of the material of the sheets to be assembled, and of the type of piercing tool employed.

9. The assembly method according to claim 2, wherein during the piercing step of the hole the value of the resistance force of the sheets resulting from the support of the sheet press system on the sheets is determined periodically, and wherein the value of the resistance force is compared to a minimal resistance force value so as to order a decrease in the advance speed instruction of the piercing tool when the value of the resistance force of the sheets is less than said minimal resistance force value.

* * * * *